US007029320B2

(12) United States Patent
Maejima

(10) Patent No.: US 7,029,320 B2
(45) Date of Patent: Apr. 18, 2006

(54) CONNECTOR

(75) Inventor: Toshiro Maejima, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/451,156

(22) PCT Filed: Aug. 6, 2002

(86) PCT No.: PCT/JP02/08028

§ 371 (c)(1),
(2), (4) Date: Jun. 30, 2003

(87) PCT Pub. No.: WO03/015221

PCT Pub. Date: Feb. 20, 2003

(65) Prior Publication Data

US 2004/0067679 A1 Apr. 8, 2004

(30) Foreign Application Priority Data

Aug. 7, 2001 (JP) ..... 2001-238886

(51) Int. Cl.
*H01R 12/24* (2006.01)

(52) U.S. Cl. ..... 439/495; 439/329

(58) Field of Classification Search ..... 439/492–497, 439/67, 260, 326, 329
See application file for complete search history.

(56) References Cited

U.S. PATENT DOCUMENTS 4,188,086 A * 2/1980 Inouye et al. ..... 439/496
4,695,108 A * 9/1987 Ichitsubo ..... 439/59
4,734,053 A * 3/1988 Imai ..... 439/329
5,690,510 A 11/1997 Chishima
5,803,752 A * 9/1998 McHugh ..... 439/74
5,813,877 A 9/1998 Nakamura ..... 439/267
5,921,785 A * 7/1999 Ii ..... 439/60
6,000,951 A 12/1999 Hansen et al. ..... 439/67
6,250,966 B1 * 6/2001 Hashimoto et al. ..... 439/631

FOREIGN PATENT DOCUMENTS

| | | |
|---|---|---|
| DE | 2215221 | 3/1972 |
| JP | 1-68677 | 5/1989 |
| JP | 7-282916 | 10/1995 |
| JP | 11-135203 | 5/1999 |

* cited by examiner

*Primary Examiner*—Hien Vu
(74) *Attorney, Agent, or Firm*—Armstrong, Kratz, Quintos, Hanson & Brooks, LLP.

(57) ABSTRACT

An object of the present invention is to provide a connector in which it is possible to easily recognize that a holder has been reliably engaged with a female housing. The connector (1) includes the holder (2) and the female housing (3). The holder (2) holds an end part (4*a*) of an FPC (4). The holder (2) has a pair of first walls (7) One of the first walls (7*a*) is provided with a lock hole (13) in its inner face. A width (L) of the first wall (7*a*) is equal to a width (La) of the FPC (4). The female housing (3) has a pair of second walls (22). One of the second walls (22*a*) is provided with an engaging projection (25) and a recess (26) in its outer face (27). The engaging projection (25) is projected from the outer face (27), and the recess (26) is recessed from the outer face (27). The engaging projection (25) is engaged in the lock hole (13), thereby to allow the female housing (3) and the holder (2) to be engaged with each other.

3 Claims, 8 Drawing Sheets

CONNECTOR

TECHNICAL FIELD

The present invention relates to a connector which is used for interconnecting electric wires or the like.

BACKGROUND ART

Various types of electronic units are mounted on an automobile as a moving body. In order to transmit electric power, control signals and so on to these electronic units, the aforesaid automobile is provided with wire harnesses. Each of the wire harnesses includes a plurality of electric wires and a plurality of connectors. The electric wire is a so-called sheathed electric wire which includes a core wire having electrical conductivity and an insulating sheath for covering the core wire.

The connector is provided with terminal metals having electrical conductivity and a connector housing of insulating material. The terminal metals are attached to end parts of the electric wires to be electrically connected to the core wires. The connector housing contains the terminal metals. The connectors of the aforesaid wire harnesses are adapted to be coupled to the connectors of the electronic units thereby to transmit the control signals and so on to the electronic units.

Meanwhile, in the aforesaid automobile, provision of additional functions has been requested by drivers, passengers and so on. For this reason, there has been a tendency that the electronic units to be mounted on the automobile have increased in number, resulting in a large size and an increase of weight of the wire harness. In order to attain compactness and light weight of the wire harness, a flat circuit body such as a flexible printed circuit (hereinafter referred to as FPC) and a flexible flat cable (hereinafter referred to as FFC) has been employed instead of the electric wires, in some cases.

The flat circuit body such as the FPC and FFC is formed in a strip-like shape having a plurality of conductors, a pair of insulating sheets and so on. The plurality of conductors are arranged in parallel to each other. The pair of insulating sheets cover these conductors, by interposing the conductors between them. In case where such flat circuit body has been employed, various types of connectors have been proposed in order to allow the flat circuit body to be electrically connected to the aforesaid electronic units and printed circuit boards, etc.

The connector which electrically connects the above described flat circuit body to the electronic units includes a holder which has been attached to an end part of the flat circuit body, and a connector housing of female type (hereinafter referred to as a female housing) which has been mounted on the printed circuit board or the like. The female housing contains the terminal metals to be electrically connected to conductors of the aforesaid printed circuit board.

The holder is provided with an engaging part, while the female housing is provided with an engaged part to be engaged with the engaging part. When the engaging part is engaged with the engaged part, the holder can be fitted to the female housing. In this state, the conductors of the flat circuit body and the aforesaid terminal metals are electrically connected to each other. Then, the terminal metals are connected to the aforesaid electronic units by way of the printed circuit board or the like. In this manner, the flat circuit body transmits the electric power, control signals and so on to the electronic units.

In case where the above described connector has been employed, the holder and the female housing have been fitted to each other in an assembling line of the wire harnesses and an assembling line of the automobiles. The aforesaid holder and the female housing can be made compact, because they are employed for connection of the flat circuit body. For this reason, it has been difficult for a worker to recognize whether or not the engaging part of the holder and the engaged part of the female housing have been reliably engaged with each other.

In short, it has been difficult to recognize whether the holder and the female housing have been reliably engaged or not. Accordingly, there has been such an anxiety that electrical connection between the conductors of the flat circuit body and the terminal metals of the female housing may become unstable. In the worst case, there has been concerned that the conductors of the flat circuit body and the terminal metals of the female housing may not be electrically connected.

In view of the above, an object of the present invention is to provide a connector in which it is possible to easily recognize whether or not a holder which holds electric wires and a female housing have been reliably engaged with each other.

DISCLOSURE OF THE INVENTION

According to the present invention, there is provided a connector comprising a female housing for containing terminal metals, a holder for holding end parts of electric wires, the aforesaid female housing and holder being adapted to be engaged with each other, whereby a first wall of the aforesaid holder and a second wall of the aforesaid female housing are overlapped on each other when the aforesaid female housing and the aforesaid holder have been engaged with each other, at least one of the aforesaid first wall and the aforesaid second wall is elastically deformed in a direction in which the aforesaid first wall and the aforesaid second wall move apart from each other when the aforesaid female housing and the aforesaid holder are engaged with each other; whereby the aforesaid first wall and the aforesaid second wall are brought into contact with each other by elastic restoring force, when the aforesaid female housing and the aforesaid holder has been engaged with each other, and a width of the aforesaid first wall in a direction intersecting the aforesaid electric wires is made far larger.

According to this feature, the width of the first wall becomes large, and so, elastic restoring force occurring when the female housing is engaged with the holder becomes large. As the results, resistance occurring until the female housing is engaged with the holder will become large, and the resistance will be lost, after the female housing has been engaged with the holder. In this manner, a feel of snap will be created when the female housing is engaged with the holder.

In the conventional connector, the width of the engaging part of the holder has been such that mechanical strength may be satisfied to the least extent, considering material of the engaging part, etc. In other words, the width of the engaging part of the holder has been to such extent that the mechanical strength only may be satisfied, and has been small. In contrast, according to the present invention, the width of the first wall is made far larger, which means such concept of the width as exceeding the conventional concept of the width which has been to such extent that the mechanical strength only has been satisfied, as described above. According to the present invention, by making the width of the first wall in the direction intersecting the electric wires far larger, it will be possible to obtain such advantage that when the female housing is engaged with the holder, the worker can recognize the restoring force of the female housing and the holder, after they have been elastically deformed. Further, according to the present invention, by making the width of the first wall in the direction intersecting the electric wires far larger, it will be possible to obtain such advantage that the worker can recognize a sound generated when the first wall comes into contact with the second wall, when the female housing is engaged with the holder.

The width of the aforesaid first wall in a direction intersecting the aforesaid electric wires may be substantially equal to the width of the aforesaid electric wires. According to this feature, the width of the first wall is reliably made large, and so, when the female housing is engaged with the holder, the feel of snap can be reliably obtained. Moreover, the concept that the width of the first wall in the direction intersecting the electric wires is substantially equal to the width of the electric wires includes the following aspects; the width of the first wall is equal to the width of the electric wires; the width of the first wall is slightly shorter than the width of the electric wires; and the width of the first wall is slightly longer than the width of the electric wires.

Either one of the aforesaid first wall and the aforesaid second wall may be provided with a recess recessed from its surface which is opposed to the other wall when the aforesaid female housing and holder have been engaged with each other.

In other words, one wall selected from among the first wall and second wall is provided with a recess which is recessed from its surface opposed to the other wall (that is, the non-selected wall) when the female housing and holder have been engaged with each other. The one wall that is selected from among the first wall and the second wall may be referred to as the selected wall.

According to this feature, an airflow is directed toward the aforesaid recess, when the first wall and the second wall come close to each other. Accordingly, a sound occurs when the aforesaid holder and the female housing are engaged with each other and the first wall and the second wall come into contact. Moreover, the sound echoes (resonates) inside the aforesaid recess and becomes louder.

A width of the other of the aforesaid first wall and second wall in the direction intersecting the aforesaid electric wires may be larger than a width of the aforesaid recess in the direction intersecting the aforesaid electric wires, and smaller than the width of the aforesaid one wall in the direction intersecting the aforesaid electric wires.

According to this feature, the width of the other wall of the aforesaid first wall and second wall becomes larger. As the results, the sound occurring when the aforesaid holder and the female housing are engaged with each other becomes louder.

The other wall may be formed so as to become gradually thinner as it comes close to the one wall. For this reason, the other wall is likely to be elastically deformed when the female housing and the holder are engaged with each other. In addition, because the other wall is formed so as to become gradually thinner as it extends away from the electric wires, the sound occurring when the aforesaid holder and the female housing are engaged with each other will become more high-pitched.

BEST MODE FOR CARRYING OUT THE INVENTION

Figure 1:
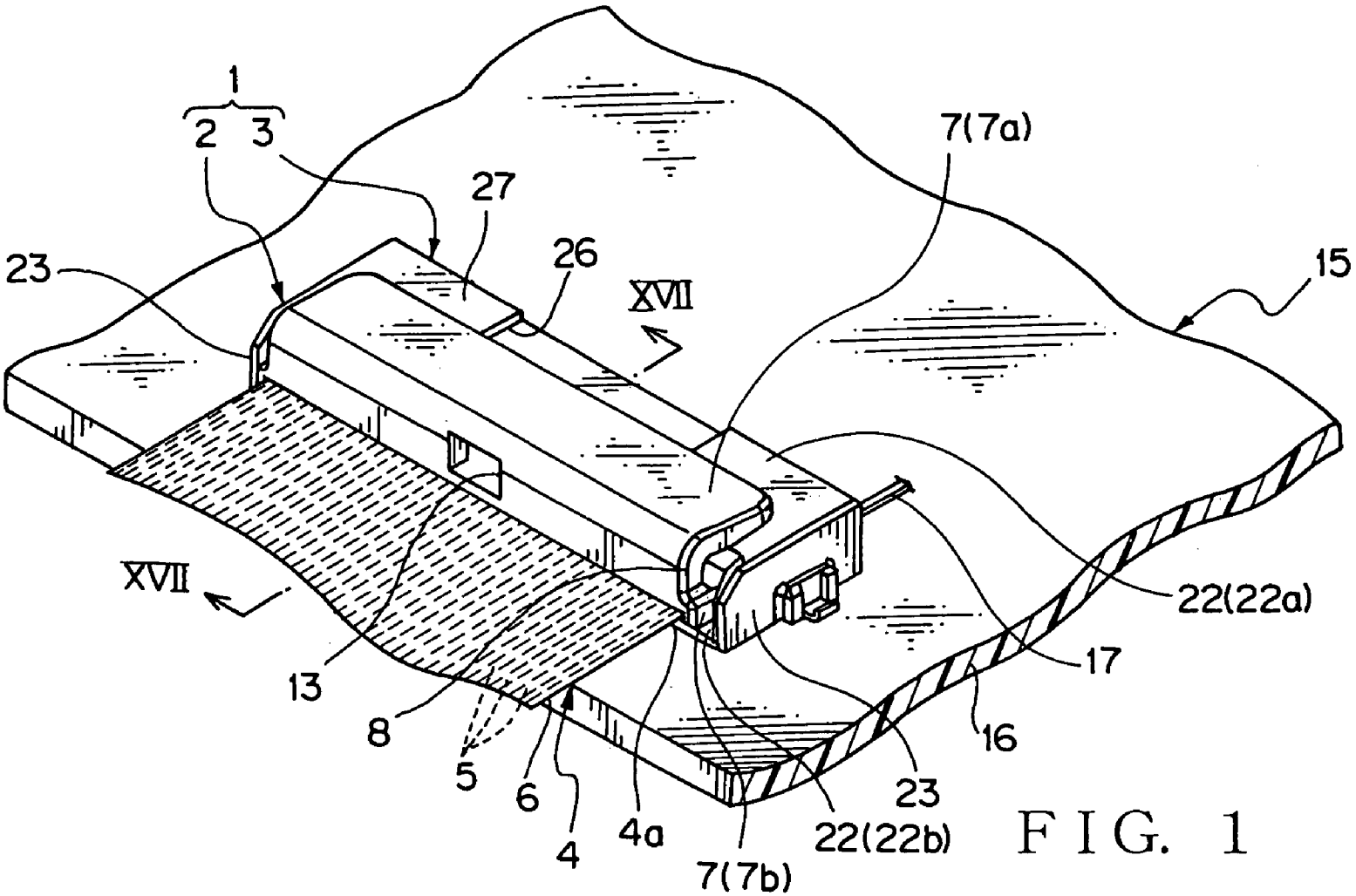
FIG. 1 is a perspective view of a connector according to one embodiment of the present invention.
Figure 2:
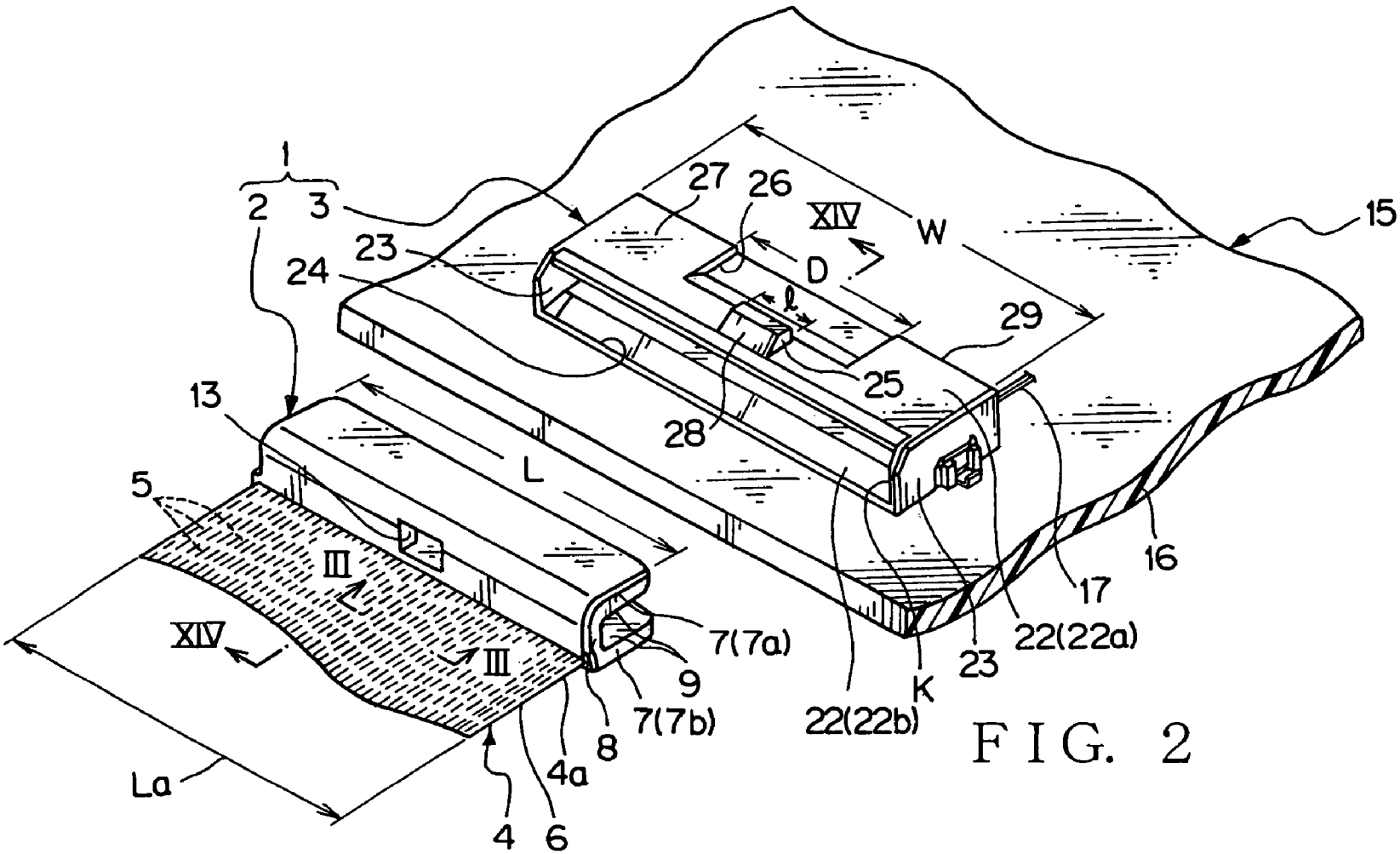
FIG. 2 is an exploded perspective view showing the connector as shown in FIG. 1.

A connector according to one embodiment of the present invention will be described referring to FIGS. 1 to 17. The connector 1 includes a holder 2 and a connector housing (hereinafter referred to as a female housing) 3, as shown in FIGS. 1 and 2. An end part 4*a* of a flexible printed circuit (hereinafter referred to as an FPC) 4 which functions as electric wires is fixed to the holder 2, and the holder 2 holds the end part 4*a*, that is, the FPC 4.

Figure 3:
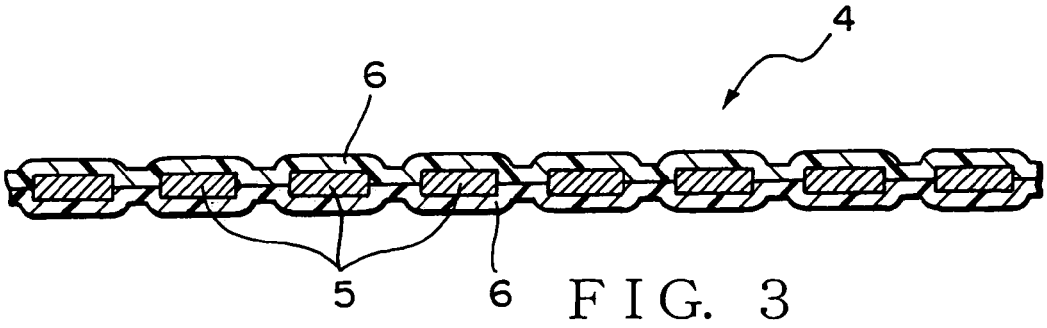
FIG. 3 is a sectional view taken along a line III—III of FIG. 2.

The FPC 4 is a flat circuit body. The flat circuit body means a circuit body which is formed in a shape of flat strip having a plurality of conductors and an insulating cover part which covers the conductors. As shown in FIG. 3, the FPC 4 includes a plurality of conductors 5 and a pair of insulating sheets 6 covering the conductors 5. The conductors 5 have a rectangular shape in cross section, and extend along one direction. The plurality of conductors 5 are in parallel to each other.

Figure 13:
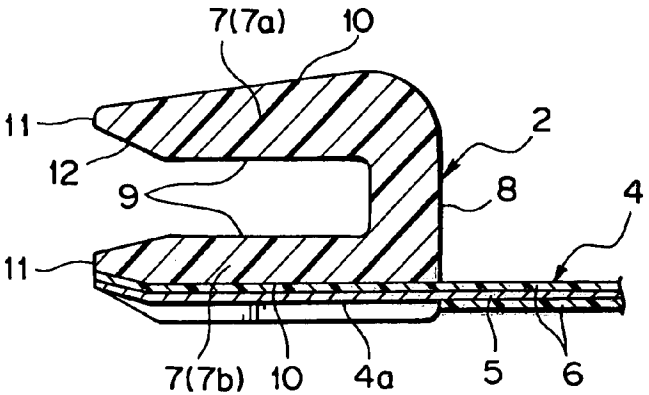
FIG. 13 is a sectional view taken along a line XIII—XIII of FIG. 9.
Figure 12:
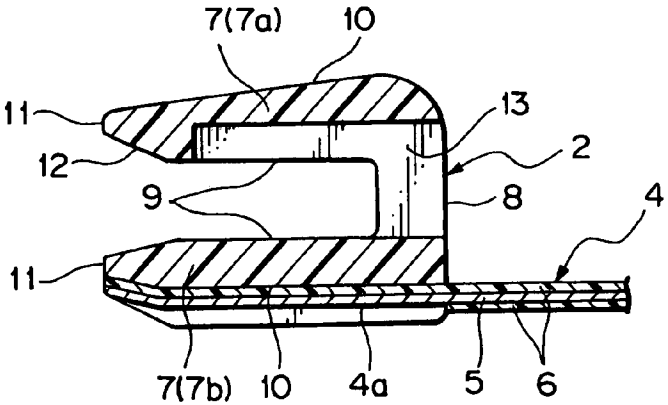
FIG. 12 is a sectional view taken along a line XII—XII of FIG. 9.

The pair of insulating sheets 6 are made of insulating synthetic resin and formed in a strip-like shape. The pair of insulating sheets 6 cover these conductors 5 by interposing the plurality of conductors 5 between them. At the aforesaid end part 4*a*, one of the pair of insulating sheets 6 is removed, as shown in FIGS. 12 and 13, so that the conductors 5 may be exposed.

Figure 11:
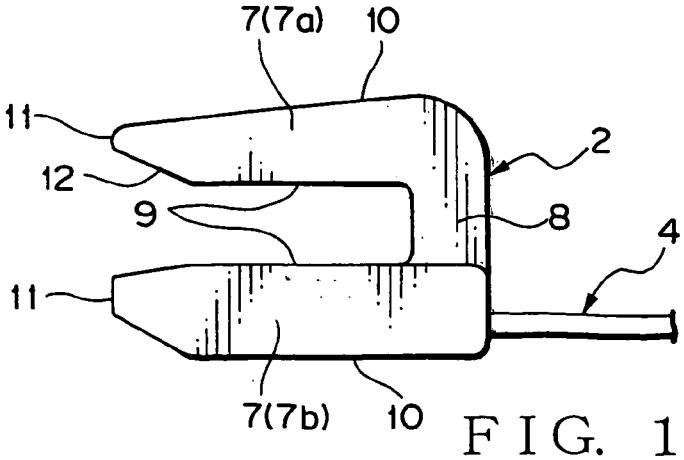
FIG. 11 is a side view of the holder as shown in FIG. 9.

The holder 2 is formed of insulating synthetic resin and can be elastically deformed. As shown in FIGS. 11 to 13, the holder 2 is formed in a substantially C-shape as seen from a lateral side and integrally provided with a pair of first walls 7 which are parallel to each other, and a connecting wall 8 which interconnects one end portions of these pair of first walls 7.

Figure 9:
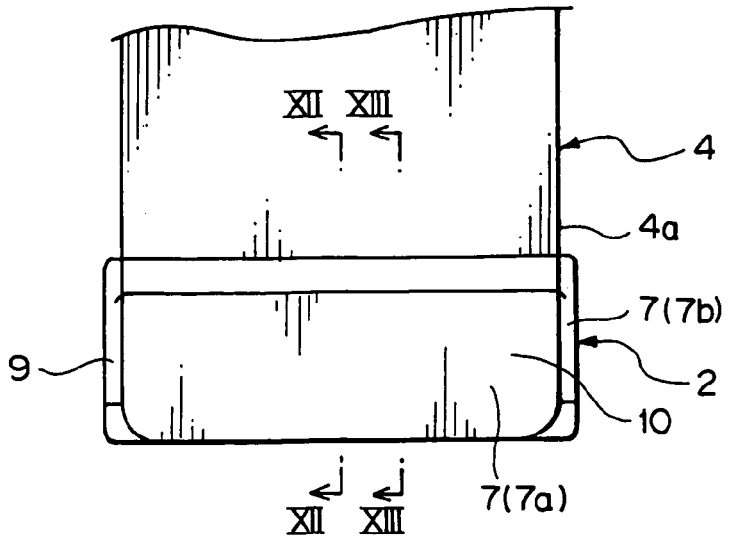
FIG. 9 is a plan view of a holder of the connector as shown in FIG. 1.
Figure 10:
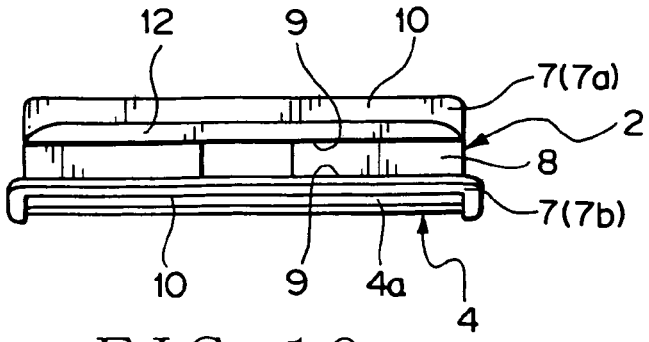
FIG. 10 is a front view of the holder as shown in FIG. 9.

The pair of first walls 7 are respectively formed in a rectangular shape in a plan view. The pair of first walls are respectively formed in a plate-like shape. The pair of first walls 7 are overlapped on each other keeping a space therebetween. As shown in FIG. 9, the pair of first walls 7 are substantially overlapped in a plan view. The pair of first walls 7 respectively have inner faces 9 opposed to each other, and outer faces 10 which are positioned outside of the holder 2 and at the opposite sides to the aforesaid inner faces 9, as shown in FIG. 10.

One of the first walls 7 (hereinafter designated by reference numeral 7*a*) is formed so as to be gradually smaller in thickness, as it extends away from the connecting wall 8. Specifically, the one first wall 7*a* is formed so as to have a gradually smaller thickness as it comes close to a second wall 22 of the female housing 3, when the holder 2 is engaged with the female housing 3. There is formed a tapered face 12 at an edge 11 of the aforesaid one first wall 7*a* remote from the connecting wall 8. The tapered face 12 is provided along an entire length of the edge 11 of the one first wall 7*a*. The tapered face 12 is inclined in a direction approaching to the inner face 9, on the way from the edge 11 toward the connecting wall 8.

The insulating sheet 6 positioned at the end part 4*a* of the FPC is affixed to the outer face 10 of the other first wall 7 (hereinafter designated by reference numeral 7*b*). When the FPC 4 is affixed to the outer face 10, a longitudinal direction of the FPC 4 is substantially perpendicular to a longitudinal direction of the other first wall 7*b*. Moreover, the FPC 4 is affixed to the outer face 10 in such a manner that the FPC 4 may not project from the edge 11 of the other first wall 7*b* remote from the connecting wall 8. In this manner, the holder 2 holds the end part 4*a* of the FPC 4.

A lock hole 13 which functions as an engaged part is formed in the one first wall 7*a* and the connecting wall 8. The lock hole 13 is recessed from the inner face 9 of the one first wall 7*a*, as shown in FIG. 12, and does not pass through the one first wall 7*a*. The lock hole 13 passes through the connecting wall 8. The lock hole 13 is formed at the middle of the first walls 7*a*, 7*b* of the holder 2 in a longitudinal direction, that is, a lateral direction of the FPC 4.

Further, a width L of the first walls 7*a*, 7*b* in a direction intersecting (perpendicular to) the FPC 4 is far larger as compared with the conventional case. In the conventional connector, the width of the engaging part of the holder has been such that mechanical strength may be satisfied to the least extent, considering material of the engaging part, etc. In other words, the width of the engaging part of the holder has been to such an extent that the mechanical strength only may be satisfied, and has been small. In contrast, according to the present invention, the width L of the first wall 7*a* is made far larger, which means such concept of the width as exceeding the conventional concept of the width which has been to such extent that the mechanical strength only has been satisfied, as described above. According to the present invention, by making the width L of the first wall 7*a* in the direction intersecting the FPC 4 far larger, it will be possible to obtain such advantage that when the female housing 3 is engaged with the holder, the worker can recognize a restoring force of the female housing 3 and the holder 2 after they have been elastically deformed. Further, according to the present invention, by making the width L of the. first wall 7*a* in the direction intersecting the FPC 4 far larger, it will be possible to obtain such advantage that the worker can recognize a sound generated when the first wall 7*a* has come into contact with the second wall 22*a*, when the female housing 3 is engaged with the holder.

The width L of the first walls 7*a*, 7*b*, in the direction intersecting (perpendicular to) the FPC 4 is substantially equal to the width W of the second wall 22*a* in the direction intersecting the FPC 4. FIG. 2 shows a width La that is measured in a direction that is perpendicular to a lengthwise direction of wires in FPC 4. The width L of the first walls 7*a*, 7*b* in the direction perpendicular to the lengthwise direction of wires in the FPC 4 is substantially equal to the width La of the FPC 4. The concept that the width L of the first wall 7*a* is substantially equal to the width La of the FPC 4 includes the following aspects; the width L of the first wall 7*a* is slightly shorter than the width La of the FPC 4; and the width L of the first wall 7*a* is slightly longer than the width La of the FPC 4. In the illustrated embodiment, the width L is equal to the width La.

The width L of the first walls 7*a*, 7*b* in the direction intersecting the FPC 4 is sufficiently longer than a width 1 of an engaging projection 25 which will be described later in a direction intersecting the FPC 4. Further, as shown in FIG. 2, the width L of the first walls 7*a*, 7*b* in the lateral direction of the FPC, that is, the direction intersecting the FPC 4 is larger than a width D of a recess 26 which will be described later in the lateral direction of the FPC, that is, the direction intersecting the FPC 4, and shorter than the width W of the second wall 22 which will be described later in the lateral direction of the FPC, that is, the direction intersecting the FPC 4. In short, the width L of the first walls 7*a*, 7*b* in the direction intersecting the FPC 4 is longer than the recess 26 and shorter than the second wall 22. The width L is slightly shorter than the width W.

It is to be noted that the width L corresponds to the width of the other of the first walls 7 and the second walls 22 described in the claims. The width W corresponds to the width of the one of the first walls 7 and the second walls 22 described in the claims. Further, the one first wall 7*a* is brought into contact with the second wall 22 which is positioned at both ends of the recess 26 in the lateral direction of the FPC 4, that is, the direction intersecting the FPC 4, when the below described engaging projection 25 is engaged in the lock hole 13 to bring the female housing 3 into contact with the holder 2. These first walls 7 correspond to the other of the first walls 7 and the second walls 22 described in the claims.

Figure 4:
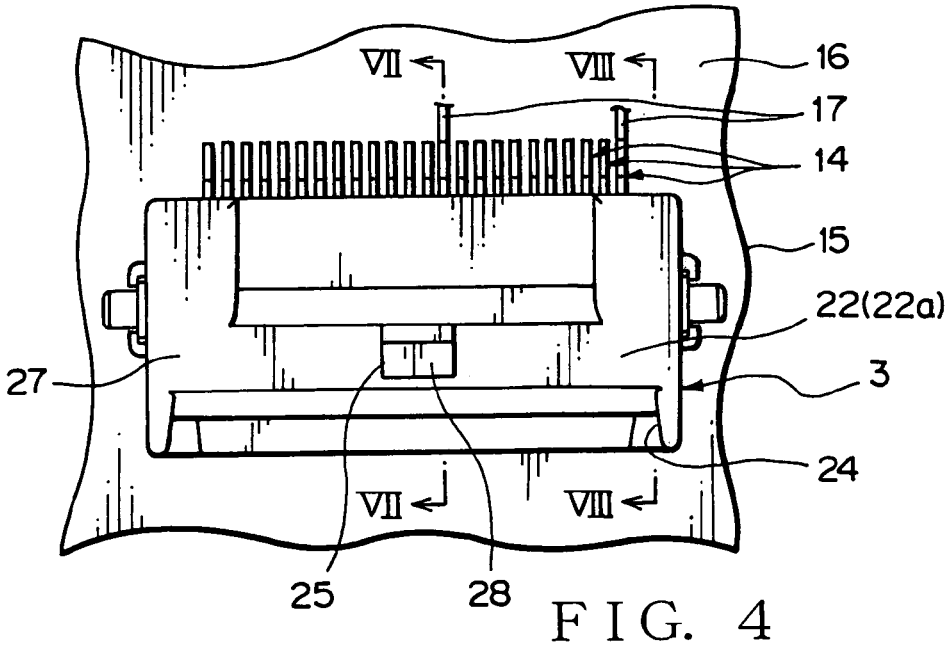
FIG. 4 is a plan view of a female housing of the connector as shown in FIG. 1.
Figure 5:
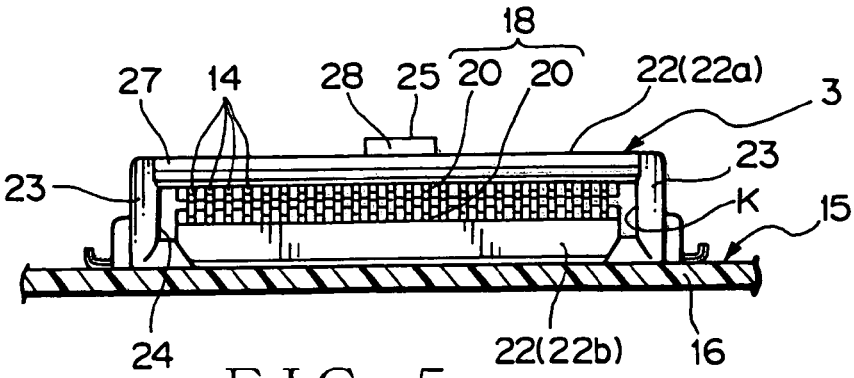
FIG. 5 is a front view of the female housing as shown in FIG. 4.
Figure 6:
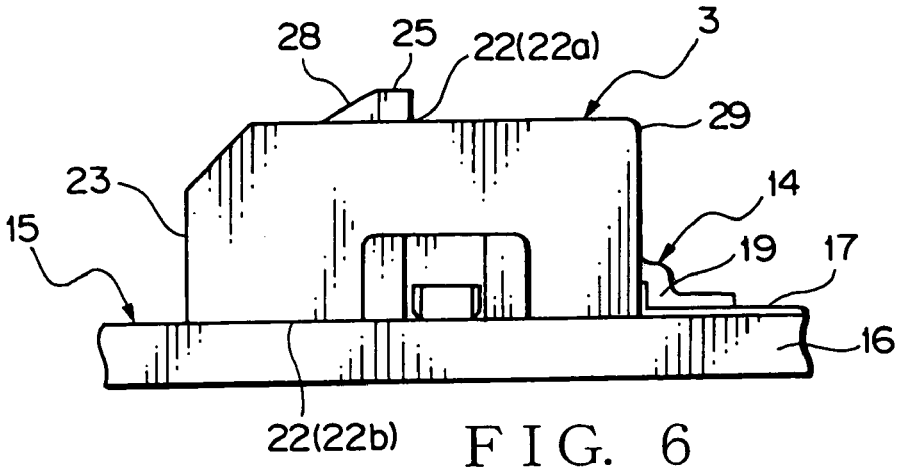
FIG. 6 is a side view of the female housing as shown in FIG. 4.

The female housing 3 is made of synthetic resin. The female housing 3 contains a plurality of terminal metals 14, as shown in FIG. 5, and mounted on a printed circuit board 15, as shown in FIGS. 1, 2, 4 and 5. The printed circuit board 15 includes a base plate 16 made of insulating synthetic resin, and a conductor pattern 17 which is formed on a surface of the base plate 16, as shown in FIGS. 1, 2, and 6 to 8. The conductor pattern 17 is made of conductive metal such as copper for example, and formed in a shape of thin film. The conductor pattern 17 is affixed to the surface of the base plate 16.

Figure 7:
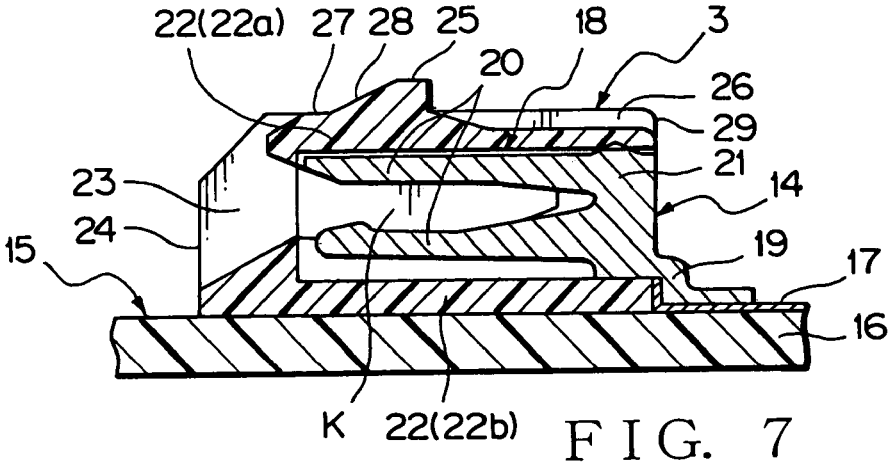
FIG. 7 is a sectional view taken along a line VII—VII of FIG. 4.

The terminal metals 14 are contained in the female housing 3 as shown in FIG. 7, and adapted to be electrically connected to the aforesaid conductor pattern 17 when the female housing 3 has been mounted on the printed circuit board 15. Each of the terminal metals 14 is obtained from a metal plate having electrical conductivity, and integrally provided with a first electrical contact portion 18 and a second electrical contact portion 19.

The first electrical contact portion 18 has a pair of clamp pieces 20 in parallel to each other and a support part 21 interconnecting respective end parts of the pair of clamp pieces 20. The pair of clamp pieces 20 extend from the support part 21 outward of the support part 21 in parallel to each other and in the same direction. The first electrical contact portion 18 can be elastically deformed in a direction in which the pair of clamp pieces 20 move apart from each other. The first electrical contact portion 18 is adapted to clamp the holder 2 and the FPC 4 attached to the holder 2 between the pair of clamp pieces 20. In this manner, the first electrical contact portion 18, that is, the terminal metal 14 is brought into electrical connection with the conductor 5 of the FPC 4.

The second electrical contact portion 19 is continued to the support part 21 of the first electrical contact portion 18. The second electrical contact portion 19 extends from the support part 21 outward of the support part 21. The second electrical contact portion 19 is brought into electrical connection with the conductor pattern 17, when the terminal metal 14 has been contained in the female housing 3 and the female housing 3 has been mounted on the printed circuit board 15. When the female housing 3 and the holder 2 have been engaged with each other, the first electrical contact portions 18 are electrically connected to the conductors 5 of the FPC 4, and the second electrical contact portions 19 are electrically connected to the conductor pattern 17 of the printed circuit board 15, so that the conductors 5 of the FPC 4 and the conductor pattern 17 of the printed circuit board 15 may be connected by way of the terminal metals 14.

Figure 8:
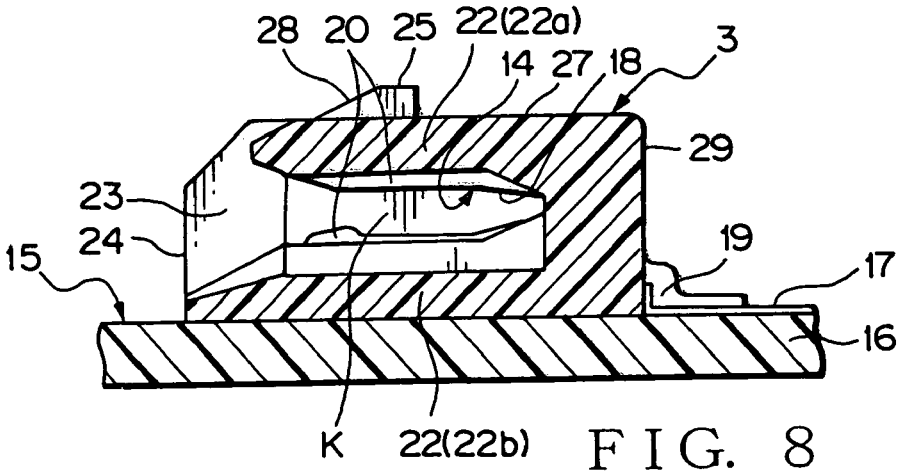
FIG. 8 is a sectional view taken along a line VIII—VIII of FIG. 4.

The female housing 3 is made of insulating synthetic resin and formed in a box-like shape as shown in FIG. 5, including a pair of second walls 22, and a pair of second connecting walls 23 interconnecting opposite ends of these second walls 22 in a longitudinal direction. The pair of second walls 22 have a substantially rectangular shape in a plan view, as shown in FIG. 4. The pair of second walls 22 are opposed to each other keeping a space therebetween, as shown in FIGS. 7 and 8, and extend in parallel to each other. It is to be noted that the second walls 22 correspond to the one of the first walls 7 and the second walls 22 described in the claims. The pair of second connecting walls 23 are opposed to each other keeping a space therebetween, and extend in parallel to each other. The terminal metals 14 are contained in a space K of the female housing 3 which is enclosed by the pair of second walls 22 and the pair of second connecting walls 23.

In a state where the other first wall 7*b* is clamped between the pair of second walls 22 and between the second connecting walls 23, the female housing 3 and the holder 2 are fitted to (engaged with) each other. On this occasion, the first walls 7 and the second walls 22 are overlapped in parallel to each other. When the holder 2 is engaged with the female housing 3, the other first wall 7*b* of the holder 2 intrudes into the female housing 3 through an opening 24 which is positioned at a left side of the aforesaid space K in FIG. 8.

One of the pair of second walls 22 (hereinafter designated by reference numeral 22*a*) is provided with the engaging projection 25 which functions as the engaging part, and the recess 26. The engaging projection 25 is projected outward of the female housing 3 from an outer face 27 of the one second wall 22*a* which is positioned outside the female housing 3. The engaging projection 25 is provided at the middle of the one second wall 22*a* in a longitudinal direction thereof, that is, the lateral direction of the FPC 4 attached to the holder 2 which has been engaged with the female housing 3. It is to be noted that the aforesaid inner face 9 and the outer face 27 correspond to the surfaces of the first wall 7 and the second wall 22 described in the claims which are opposed to each other. The outer face 27 is the surface which is opposed to the one first wall 7*a*.

The engaging projection 25 is engaged in the aforesaid lock hole 13. When the engaging projection 25 has been engaged in the lock hole 13, the female housing 3 and the holder 2 are engaged with each other (mounted). Description in the claims that the female housing 3 and the holder 2 are engaged with each other means the fact that the engaging projection 25 is engaged in the lock hole 13 thereby to mount the holder 2 to the female housing 3.

The engaging projection 25 is provided with a second tapered face 28 at its end part close to the holder 2, when the female housing 3 and the holder 2 are engaged with each other. The second tapered face 28 is gradually inclined in a direction away from the aforesaid holder 2 on the way from the aforesaid outer face 27 outward of the female housing 3.

The recess 26 is recessed from the outer face 27 of the one second wall 22*a*. The recess 26 is formed in a rectangular shape in a plan view. The recess 26 is provided at the middle of the one second wall 22*a* in the longitudinal direction, that is, the lateral direction of the FPC 4 attached to the holder 2 which has been engaged with the female housing 3. The recess 26 is located more remote from the holder 2 than the engaging projection 25. The recess 26 opens at an edge 29 of the one second wall 22*a* which is remote from the holder 2. The other second wall 22 (hereinafter designated by reference numeral 22*b*) is fixed to the printed circuit board 15.

In order to assemble the above described connector 1, the insulating sheet 6 located at the end part 4*a* of the FPC 4 is affixed to the outer face 10 of the second first wall 7*b* of the holder 2, as a first step. Thus, the holder 2 holds the end part 4*a* of the FPC 4. Then, the terminal metals 14 are contained in the female housing 3, and the other second wall 22*b* of the female housing 3 is fitted to the printed circuit board 15.

Figure 14:
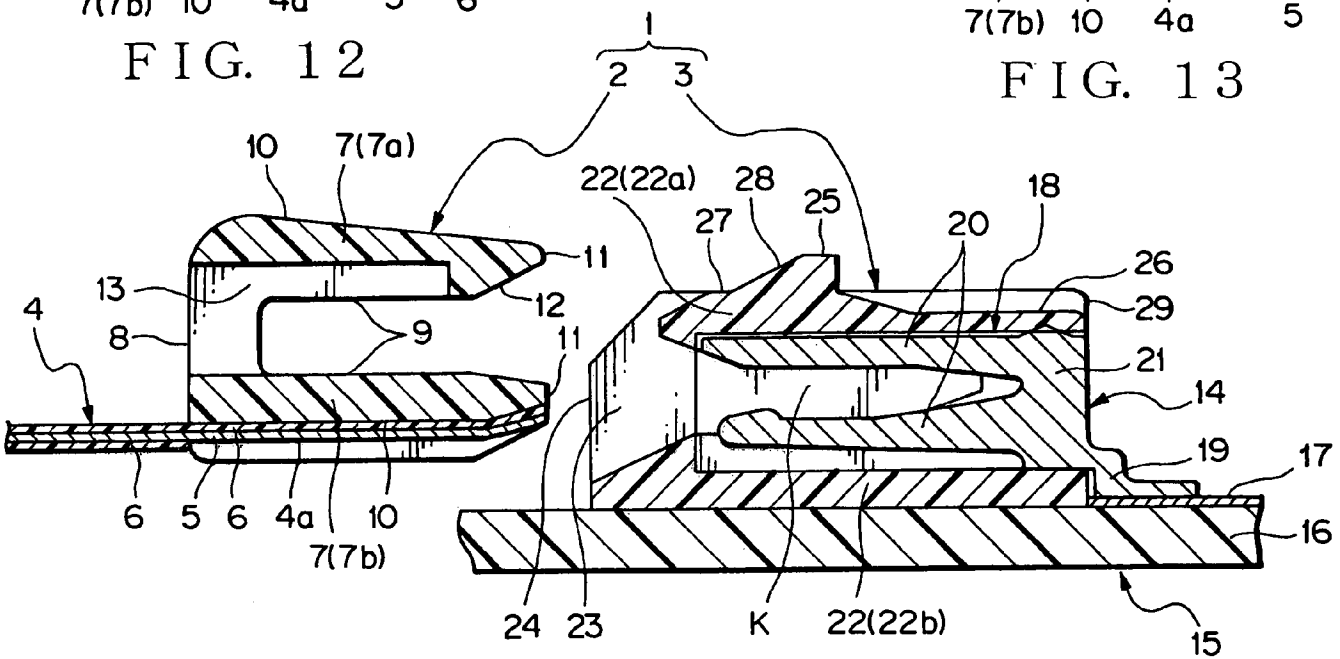
FIG. 14 is a sectional view taken along a line XIV—XIV of FIG. 2.
Figure 15:
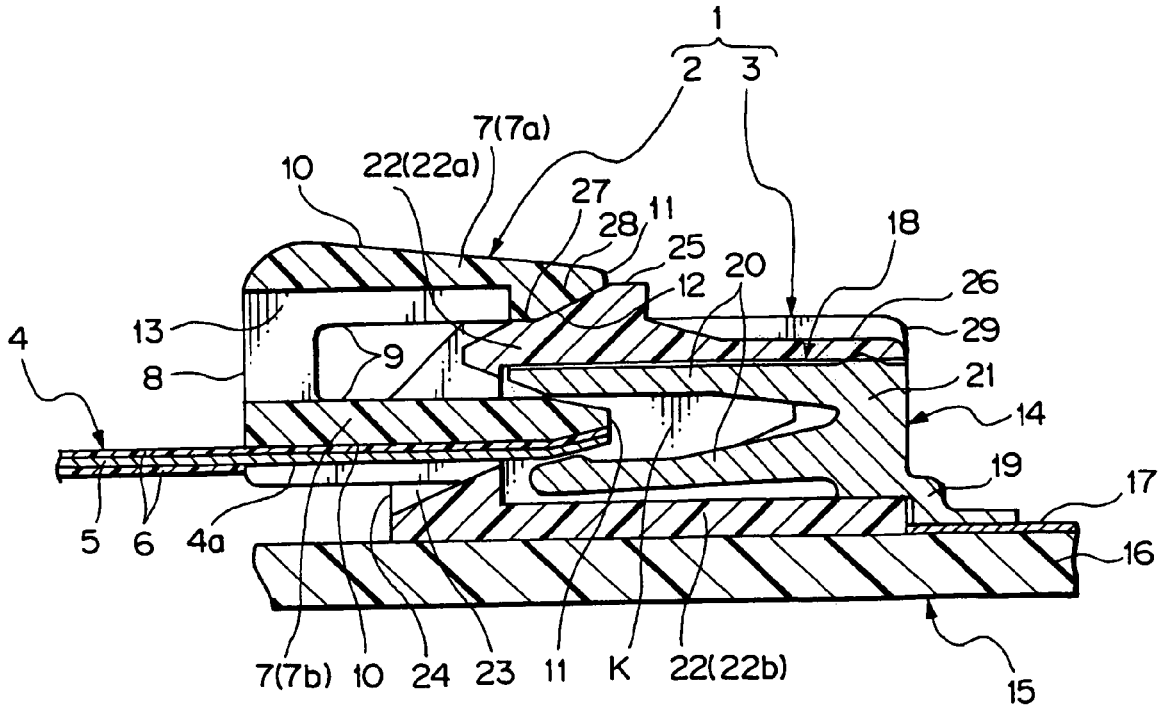
FIG. 15 is a sectional view showing a state in which the other first wall of the holder has intruded into the female housing from a state as shown in FIG. 14.

Thereafter, the other first wall 7*b* of the holder 2 is positioned relative to the opening 24 of the female housing 3 as shown in FIG. 2 and FIG. 14. Then, the other first wall 7*b* is inserted into the female housing 3. As the tapered faces 12 and 28 are brought into contact with each other, as shown in FIG. 15, the other first wall 7*b* and the end part 4*a* of the FPC 4 intrude between the pair of clamp pieces 20 of the electrical contact portion 18.

Figure 16:
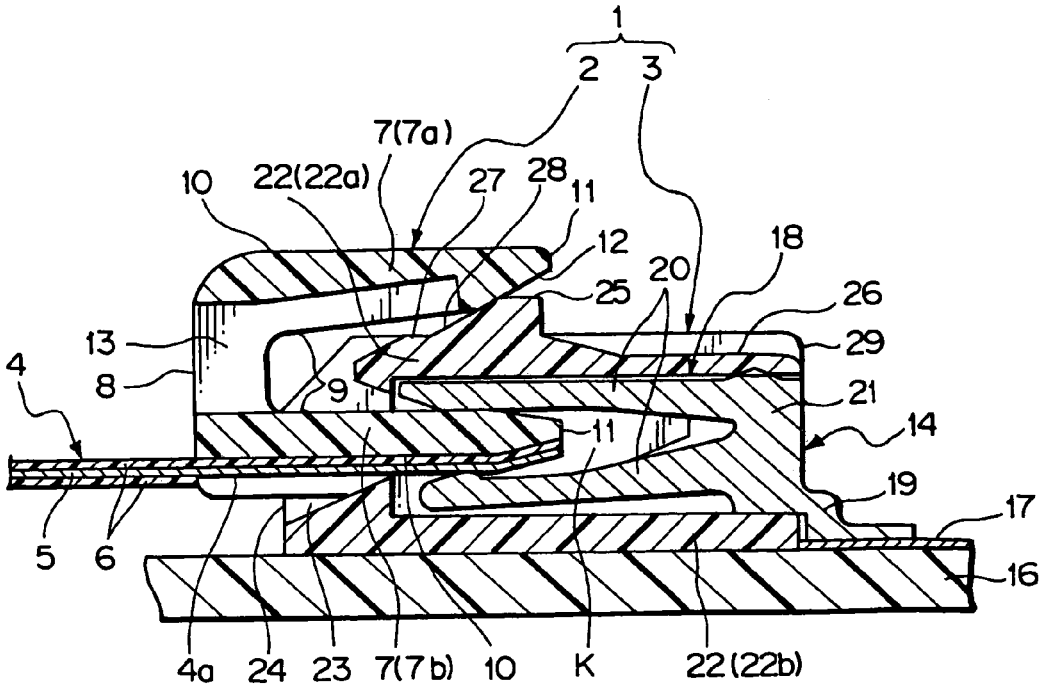
FIG. 16 is a sectional view showing a state in which the one first wall of the holder is elastically deformed in a direction away from the one second wall of the female housing from the state as shown in FIG. 15.

As the other first wall 7*b* is being inserted into the female housing 3, the one first wall 7*a* is elastically deformed in a direction away from the one second wall 22*a*, as shown in FIG. 16, because the tapered faces 12, 28 are inclined as described above. In this manner, when the female housing 3 and the holder 2 are engaged with each other, at least one of the walls 7*a* and 22*a* is elastically deformed in such a direction that the first wall 7*a* and the second wall 22*a* move apart from each other. At the same time, the second first wall 7*b* of the holder 2 and the end part 4*a* of the FPC 4 intrude deeper between the pairs of clamp pieces 20, and the terminal metals 14 are elastically deformed in such a direction that the pairs of clamp pieces 20 move apart from each other.

Figure 17:
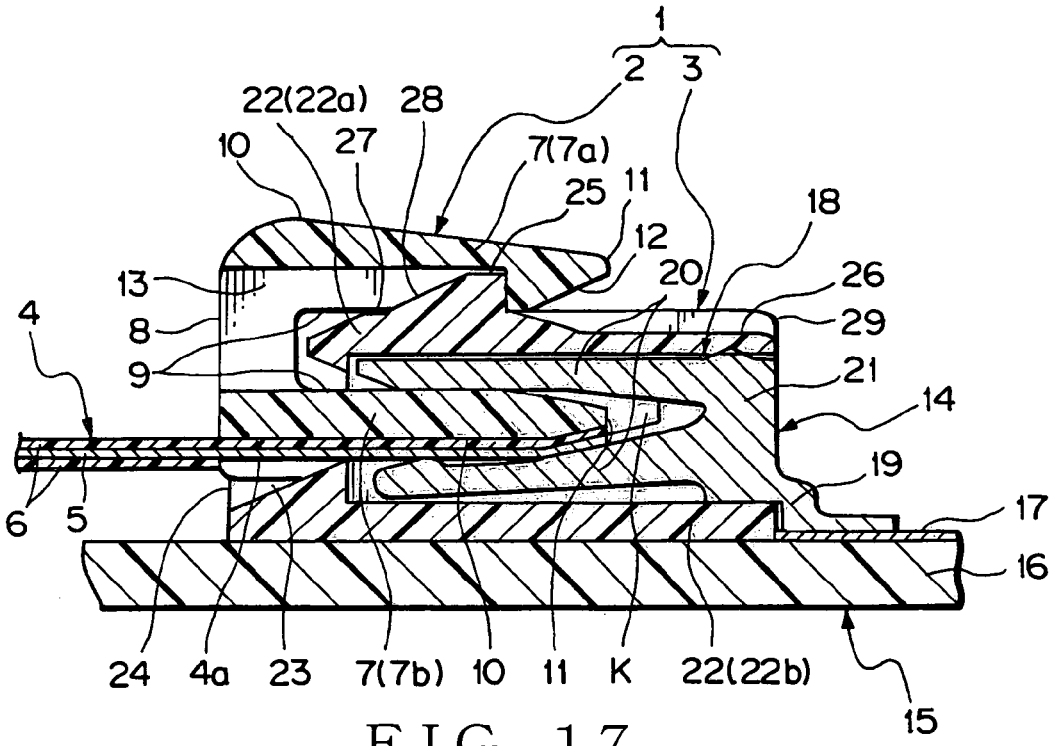
FIG. 17 is a sectional view taken along a line XVII—XVII of FIG. 1.

Thereafter, as the other first wall 7*b* is further inserted into the female housing 3, the engaging projection 25 intrudes in the lock hole 13, as shown in FIG. 17. Thus, the engaging projection 25 will be engaged in the lock hole 13. Then, the one first wall 7*a* is forced to approach the one second wall 22*a* by elastic restoring force, thereby to bring these walls 7*a*, 22*a* into contact with each other. In this manner, the one first wall 7*a* comes into contact with the one second wall 22*a* which is positioned at opposite ends of the recess 26 in the direction intersecting the FPC 4. On this occasion, the one first wall 7*a* violently strikes the one second wall 22*a* with the elastic restoring force, and generates a sound of snap, for example.

The sound thus generated echoes (resonates) inside the recess 26 and becomes louder. Further, the sound will become more high-pitched, because the one first wall 7*a* is formed gradually thinner in the direction away from the FPC 4, that is, in the direction close to the one second wall 22*a*.

According to the present embodiment, the width L of the first wall 7*a* and the width W of the second wall 22*a* are substantially equal to each other. The width L of the first wall 7*a* is substantially equal to the width La of the FPC 4. In this manner, the width L of the first wall 7*a* is made far larger. Due to this larger width L of the first wall 7*a*, the elastic restoring force created when the female housing 3 is engaged with the holder 2 becomes large. As the results, resistance occurring until the female housing 3 is engaged with the holder 2 will become larger, and the above described resistance will be lost, after the female housing 3 has been engaged with the holder 2. In this manner, a feel of snap will be created when the female housing 3 is engaged with the holder 2. Accordingly, it will be possible to easily recognize that the holder 2 and the female housing 3 have been engaged with each other, and thus, a feeling of engagement between the holder 2 and the female housing 3 will be improved.

There is formed the recess 26 in the second wall 22*a* of the two walls 7*a* and 22*a* which are brought into contact with each other after once separated, when the female housing 3 and the holder 2 are engaged with each other. Due to this structure, an airflow is directed toward the recess 26, when the first wall 7*a* and the second wall 22*a* come close to each other. Accordingly, a sound is generated when the female housing 3 and the holder 2 are engaged with each other, and the first wall 7*a* comes into contact with the second wall 22*a*. Moreover, the sound echoes (resonates) inside the recess 26 and becomes louder. Therefore, it will be possible to easily recognize that the female housing 3 and the holder 2 have been engaged with each other, and thus, the feeling of engagement between the holder 2 and the female housing 3 will be improved.

Moreover, the width L of the first wall 7*a* is larger than the width D of the recess 26, and smaller than the width W of the second wall 22*a*. The width L of the first wall 7 is thus made larger. Accordingly, the above mentioned sound becomes louder. Therefore, it will be possible to recognize more easily that the female housing 3 and the holder 2 have been engaged with each other, and thus, the feeling of engagement between the holder 2 and the female housing 3 will be further improved.

Further, the first wall 7*a* of the two walls 7*a* and 22*a* is formed so as to be gradually thinner as it comes close to the second wall 22*a*. As the results, the aforesaid first wall 7*a* is likely to be elastically deformed when the female housing 3 and the holder 2 are engaged with each other. In addition, because the aforesaid first wall 7*a* is formed so as to be gradually thinner as it comes close to the second wall 22*a*, the sound generated when the first wall 7*a* and the second wall 22*a* has come into contact with each other will become more high-pitched. Therefore, it will be possible to recognize more easily that the female housing 3 and the holder 2 have been engaged with each other, and thus, the feeling of engagement between the holder 2 and the female housing 3 will be further improved.

In the above described embodiment, the recess 26 is provided in the one second wall 22*a* of the female housing 3. However, the recess may be formed in the first wall 7*a* of the holder 2, according to the present invention. In this case, the recess 26 is preferably recessed from the inner face 9 of the first wall 7*a*. Moreover, according to the present invention, both the first wall 7*a* and the second wall 22*a* may be respectively provided with the recesses 26. Further, the second wall 22*a* may be made gradually thinner as it comes close to the first wall 7*a*. Alternatively, the recess 26 need not be provided according to the present invention.

Further, in the above described embodiment, the FPC 4 is employed as the electric wires. However, according to the present invention, not only the FPC 4 but also a flat circuit body such as a flexible flat cable (FFC), or a sheathed electric wire having a round shape in cross section may be employed. Still further, the holder 2 holding the end part 4*a* of the FPC 4 is employed in the embodiment. However, according to the present invention, it is apparent that a male type connector housing (a so-called male housing) which contains terminal metals and is adapted to be engaged with the female housing 3 may be employed as the holder. In this case, it is apparent that the male housing holds end parts of the electric wires by way of the terminal metals.

Still further, in the above described embodiment, the length L is slightly smaller than the width W. However, it is apparent that the length L may be slightly larger than the width W, or the length L may be equal to the width W, according to the present invention. Moreover, the width L is equal to the width La, in the embodiment. However, it is apparent, according to the present invention, that the length L may be slightly larger than the width La, or the length L may be slightly smaller than the width La.

INDUSTRIAL APPLICABILITY

As has been described above, in the connector according to the present invention, the feel of snap and the sound will be generated when the female housing and the holder come into engagement. Accordingly, it will be possible to easily recognize that the female housing and the holder have been engaged with each other, and thus, the feeling of engagement between the holder and the female housing will be improved.

The invention claimed is:

1. A connector comprising a female housing for containing terminal metals, a U shaped holder for holding end parts of electric wires extending in a lengthwise direction having a lock hole located substantially in the middle of a connecting wall connected between a top and bottom wall of the holder, said female housing and said holder being adapted to be engaged with each other, whereby said top wall forming a first wall of said holder and an upper wall forming a second wall of said female housing are overlapped on each other when said female housing and said holder have been engaged with each other, at least one of said first wall and said second wall is elastically deformed in a direction in which said first wall and said second wall move apart from each other when said female housing and said holder are engaged with each other;

whereby said first wall and said second wall are brought into contact with each other by elastic restoring force when said female housing and said holder has been engaged with each other, and a width of said first wall in a direction perpendicular to the lengthwise direction of said electric wires is substantially equal to a width of said electric wires, and substantially equal to a width of said second wall, wherein said first wall is formed so as to be gradually thinner in thickness with said width, in a direction from said connecting wall toward said second wall.

2. The connector as claimed in claim 1, wherein one wall selected from among said first wall and said second wall is provided with a recess which is recessed from a surface of the selected wall which is opposed to the other wall, when said female housing and said holder have been engaged with each other.

3. The connector as claimed in claim 2, wherein a width of the other wall in the direction perpendicular to the lengthwise direction of said electric wires is larger than a width of said recess in the direction perpendicular to the lengthwise direction of said electric wires, and smaller than said width of the selected wall in the direction perpendicular to the lengthwise direction of said electric wires.

* * * * *